US009833087B1

(12) United States Patent
Richardson

(10) Patent No.: US 9,833,087 B1
(45) Date of Patent: Dec. 5, 2017

(54) DECORATIVE PILLOW SYSTEM INCLUDING A PILLOW HAVING AN ENCLOSED POCKET, AND DIFFERENTLY-THEMED PILLOW CASES, AND METHODS OF SELECTIVELY DECORATING A PILLOW

(71) Applicant: Valerie M. Richardson, Phoenix, AZ (US)

(72) Inventor: Valerie M. Richardson, Phoenix, AZ (US)

( * ) Notice: Subject to any disclaimer, the term of this patent is extended or adjusted under 35 U.S.C. 154(b) by 0 days.

(21) Appl. No.: 15/074,293

(22) Filed: Mar. 18, 2016

(51) Int. Cl.
*A47G 9/10* (2006.01)
*A47G 9/02* (2006.01)
*A47G 9/04* (2006.01)

(52) U.S. Cl.
CPC ..... *A47G 9/10* (2013.01); *A47G 9/0253* (2013.01); *A47G 9/04* (2013.01)

(58) Field of Classification Search
CPC ..... A47G 9/10; A47G 2009/1018; A47G 9/0253; A47G 9/0238; A47C 7/383; A47C 7/38
USPC ..... 5/636, 639, 645, 490, 485, 482; D6/601
See application file for complete search history.

(56) References Cited

U.S. PATENT DOCUMENTS 3,290,703 A * 12/1966 Worrall ..... A47G 9/0253 5/484
3,613,133 A * 10/1971 Isola et al. ..... A47G 9/02 428/690
4,875,245 A * 10/1989 Isola ..... A47G 9/02 5/482
5,157,799 A * 10/1992 Aird ..... A47G 9/0253 5/490
D346,086 S 4/1994 Jones
7,900,303 B2 * 3/2011 Mastrosimone-Gese A47D 13/083 5/639
8,032,959 B2 10/2011 Rowson et al.
8,205,284 B2 * 6/2012 Mastrosimone-Gese A47D 13/083 5/639
8,333,278 B2 * 12/2012 Smith ..... B65D 5/36 206/495
8,615,830 B2 12/2013 McQuoid
D702,971 S 4/2014 Mitchell
8,875,324 B2 11/2014 Borgione
9,009,889 B1 4/2015 Cohen
2005/0120482 A1 6/2005 Robie
2009/0235454 A1 9/2009 Leverette
2010/0059531 A1 * 3/2010 Smith ..... B65D 5/36 220/666
2010/0175194 A1 * 7/2010 Mastrosimone-Gese A47D 13/083 5/639
2011/0179575 A1 * 7/2011 Mastrosimone-Gese A47D 13/083 5/639
2015/0113734 A1 4/2015 Arabo

* cited by examiner

*Primary Examiner* — Robert G Santos
(74) *Attorney, Agent, or Firm* — Michael W. Goltry; Robert A. Parsons; Parsons & Goltry

(57) ABSTRACT

A decorative pillow system includes a pillow and pillowcases. The pillow includes a pocket, and a pocket inlet to the pocket. Each of the pillowcases is a removable cover for the pillow and has a decorative theme. The decorative themes of the pillowcases are different from one another. One of the pillowcases is drawn over the pillow, and at least one of the remaining pillowcases is stored in the pocket.

9 Claims, 9 Drawing Sheets

20
22A
80A
82
90
68
30
62
71
61
70
64
31
51
50
42
44
40
41
21
34
66
22D
80D
96
92
80B
22B
94
80C
22C 60
90
80A
22A
20
82
62
61
71
70

20
90
80A
60
82
22A
21
62
64
30
51
50
34
31
61
71
70
66

20
21
22B
22D
22A
22C
34
44
50
70
42
40
41
51
71
31
61
46
62
30
64
60
92
80B
82
80D
96
80A
90
94
80C

DECORATIVE PILLOW SYSTEM INCLUDING A PILLOW HAVING AN ENCLOSED POCKET, AND DIFFERENTLY-THEMED PILLOW CASES, AND METHODS OF SELECTIVELY DECORATING A PILLOW

FIELD OF THE INVENTION

The present invention relates generally to pillows and, more particularly, to decorative pillows and to methods of decorating pillows with decorative pillowcases.

BACKGROUND OF THE INVENTION

A pillow is a support for the head or other parts of the body, and is used while sleeping, resting, sitting, or reclining. A typical pillow includes a fabric envelope that contains a soft stuffing, such as down feathers, foam, or other selected soft stuffing. Bed pillows are normally covered with a pillowcase, whereas pillows used in a living room are normally covered in a comparatively sturdy pillowcase.

The common pillow, utilized in the generally functional manner described above, typically has opposing top and bottom panels that are fixedly joined at their periphery to enclose a cushioning material inside the pillow. The top and bottom panels are generally made out of cotton, polyester, silk, cotton/polyester blends, or other selected similar material or combination of similar materials. The common sleeping pillow has a plain surface that is covered with a pillowcase, which often has a design on it, that may also be made out of a variety of different materials. As well known to those skilled in the art, a wide variety of different materials are utilized as the cushioning material. Generally, these are selected for the ability to comfortably support the user.

Pillows are also utilized, often solely, as decorative items that are placed on the bed, couch, chair or other piece of furniture, adding flair to the furniture item. Typically, these decorative pillows have a covering surface that is colored and/or incorporates one or more design elements. Pillowcases are less commonly utilized with these types of pillows. A decorative pillow will generally be selected to present a chosen theme or to compliment the furniture and/or room in which the pillow is kept, which may match or contrast with the colors or design of the material utilized on the furniture item or used in the room. However, tastes change and interior furniture and room décor can change, including due to seasonal changes, holidays, events, and the like, rendering the chosen decorative pillows unsuitable, requiring the user to dispose of the old decorative pillows and acquire new decorative pillows to satisfy given needs or tastes, often at substantial cost. In pillows used with removable decorative pillowcases, replacing such pillowcases from time-to-time as the need may arise can lead to the loss or misplacement of the unused pillowcases. Given these and other deficiencies in the art, the need for continued improvement in the field of decorative pillows is evident.

SUMMARY OF THE INVENTION

According to the principle of the invention, a decorative pillow system includes a pillow, and pillowcases. The pillow includes a pocket, and a pocket inlet to the pocket. Each of the pillowcases is a removable cover for the pillow and has a decorative theme, and the decorative themes of the pillowcases are different from one another. At least one of the pillowcases is stored in the pocket, and a remaining one of the pillowcases is drawn over the pillow. Each of the pillowcases includes a closure. Each of the pillowcases is in an open position, when the closure thereof is in an opening position. Each of the pillowcases is in a closed position, when the closure thereof is in a closing position. The closure of the remaining one of the pillowcases drawn over the pillow is in the closing position enclosing the pillow therein. Each of the closures is a slide fastener, which is a zipper in an illustrative embodiment.

According to the principle of the invention, a decorative pillow system includes a pillow, and pillowcases. The pillow includes a pocket, a pocket inlet to the pocket, and a pocket inlet closure. The pocket inlet is in an open position, when the pocket inlet closure is in an opening position. The pocket inlet is in a closed position, when the pocket inlet closure is in a closing position. Each of the pillowcases is a removable cover for the pillow and has a decorative theme. The decorative themes of the pillowcases are different from one another. At least one of the pillowcases is stored in the pocket and is enclosed by the pocket inlet closure. A remaining one of the pillowcases is drawn over the pillow. The pocket inlet closure is a slide fastener, specifically a zipper an illustrative embodiment. Each of the pillowcases includes a pillowcase closure. Each of the pillowcases is in an open position, when the pillowcase closure thereof is in an opening position. Each of the pillowcases is in a closed position, when the pillowcase closure thereof is in a closing position. The pillowcase closure of the remaining one of the pillowcases drawn over the pillow and is in the closing position enclosing the pillow therein. Each of the pillowcase closures is a slide fastener, specifically a zipper in an illustrative embodiment.

Consistent with the foregoing summary of illustrative embodiments, the invention also includes associated methods of decorating a pillow.

BRIEF DESCRIPTION OF THE DRAWINGS

Referring to the drawings.

DETAILED DESCRIPTION

Figure 1:
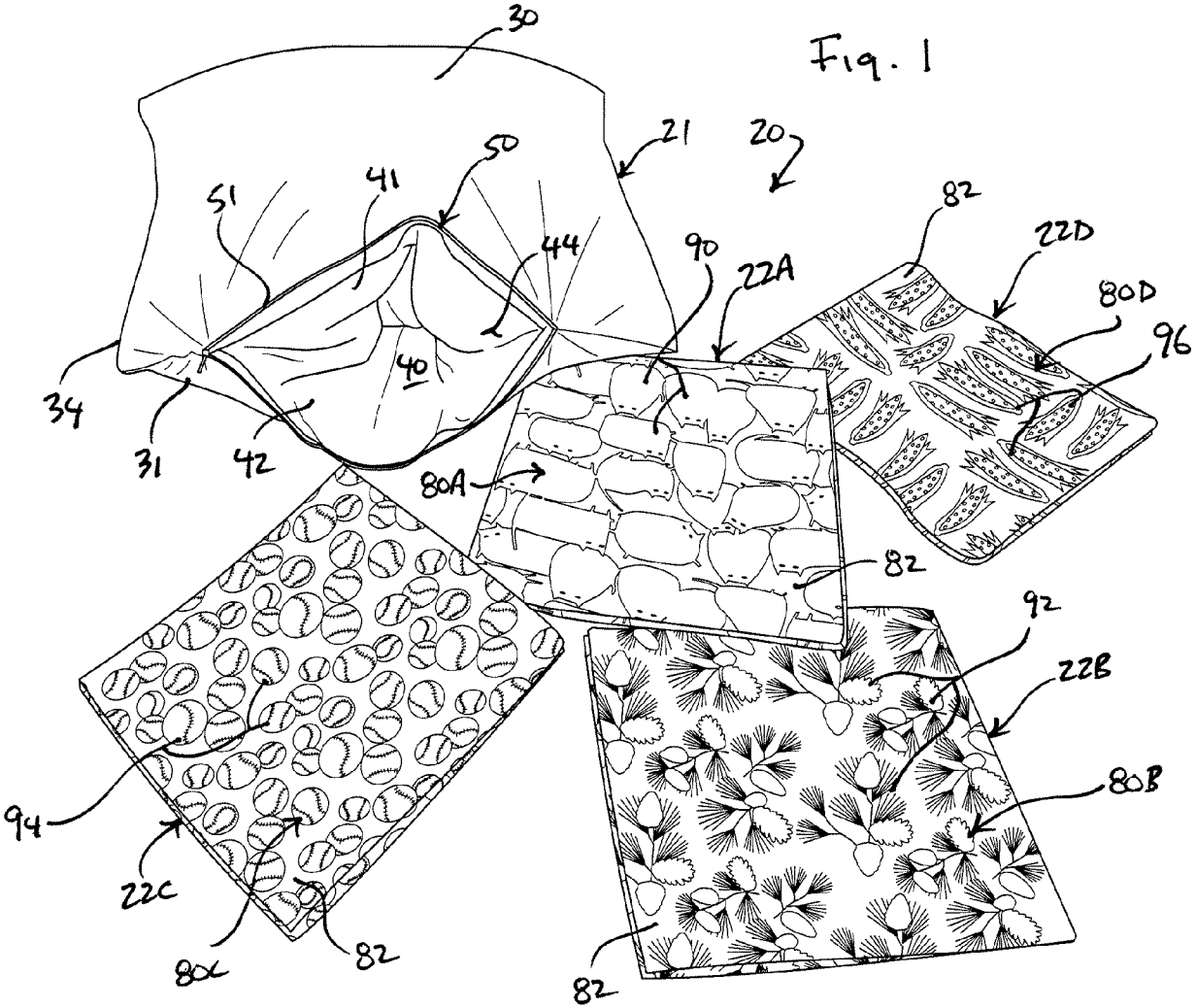
FIG. 1 is a perspective view of a decorative pillow system, the decorative pillow system includes a pillow and pillowcases, the pillow includes a pocket, a pocket inlet to the pocket, and a pocket inlet closure, the pocket inlet is in an open position corresponding to an opening position of pocket inlet closure, each of the pillowcases is a removable cover for the pillow and has a decorative theme, and the decorative themes of the pillowcases are different from one another.

Turning now to the drawings, in which like reference characters indicate corresponding elements throughout the several views, attention is directed to FIG. 1 in which there is seen decorative pillow system 20, including pillow 21, and pillowcases 22. Pillow 21 includes top panel 30 and bottom panel 31 joined together at their periphery to define a peripheral edge 34 around pillow 21. Pillow 21 has the customary cushioning material enclosed between top panel 30 and bottom panel 31. Top panel 30 and bottom panel 31 are joined customarily with stitching, adhesive, or the like, that join top and bottom panels 30 and 31 fixedly together. Top and bottom panels 30 and 31 are made of cotton, polyester, a cotton/polyester blend, silk, or other selected textile material or combination of selected textile materials commonly used for pillows. Top and bottom panels 30 and 31 are square in shape in this example, and can be made in other selected shapes as desired, such as rectangular, round, oval, etc. The cushioning material of pillow 21 is a conventional pillow fill material, such as natural or synthetic fibers, down, foam material, or the like, that is selected to make pillow 21 be comfortably padded and, therefore, suitable for use as a headrest when sleeping or resting or as a support when sitting, sleeping, or reclining.

Top and bottom panels 30 and 31 are joined together to form an envelope shaped configuration in which is disposed pocket 40 inside the envelope. Pocket 40 is formed from a pair of pocket panels, including first pocket panel 41 and second pocket panel 42, that are joined along three sides to form the inside closed portion of pocket 40 which extends into the pillow 21 cushioning material such that is it enclosed by cushioning material 20. The fourth side of first pocket panel 41 is joined to top panel 30, and the fourth side of second pocket panel 42 is joined to bottom panel 31, which attaches pocket 40 to pillow 21 and forms a pocket inlet 44 to pocket 40 in peripheral edge 34 of pillow 21. First and second pocket panels 41 and 42 are joined together and to the respective top and bottom panels 30 and 31 with stitching, adhesive, heat bonding, or the like. Pocket 40 is sufficiently smaller than pillow 21 such that pocket 40 is surrounded, except at pocket inlet 44 in peripheral edge 34 of pillow 21, by the pillow 21 cushioning material to provide a selected amount of padding around pocket 40. Pocket 40 is accessible through pocket inlet 44. One or more of pillowcases 22 placed in pocket 40 through pocket inlet 44 are enclosed by the pillow 21 cushioning material 20. Accordingly, one or more of pillowcases 22 inside pocket 40 will be protected by the pillow cushioning material and a person using pillow 21 will not be unduly affected by those articles.

Pillow 21 further includes a pocket inlet closure 50. Pocket inlet 44 is open to enable access therethrough to pocket 40 when pocket inlet closure 50 is in an open or opening position in FIGS. 1-3. Pocket inlet 44 is closed to disable access therethrough to pocket 40 when pocket inlet closure 50 is in a closed position in FIG. 4. Pocket inlet closure 50 is formed along peripheral edge 34 at pocket inlet 44. Pocket inlet closure 50 is a slide fastener, specifically a zipper 51 in this illustrative embodiment, such as a metal, plastic, or composite zipper. Zipper 51, a conventional closure, consist of the customary toothed tracks or spiral metal or plastic coils, each bordering one of two edges of peripheral edge 34 at pocket inlet 44 to be joined, and a sliding piece that interlocks them in the closing position of the zipper 51 closing pocket inlet 44 when the sliding piece is pulled in one direction and that separates them in the opening position of the zipper 51 opening pocket inlet 44 when the sliding piece is pulled in the opposite direction. Various snap, button, hook-and-loop, or like or similar fasteners can be used for pocket inlet closure 50 in alternate embodiments.

Figure 2:
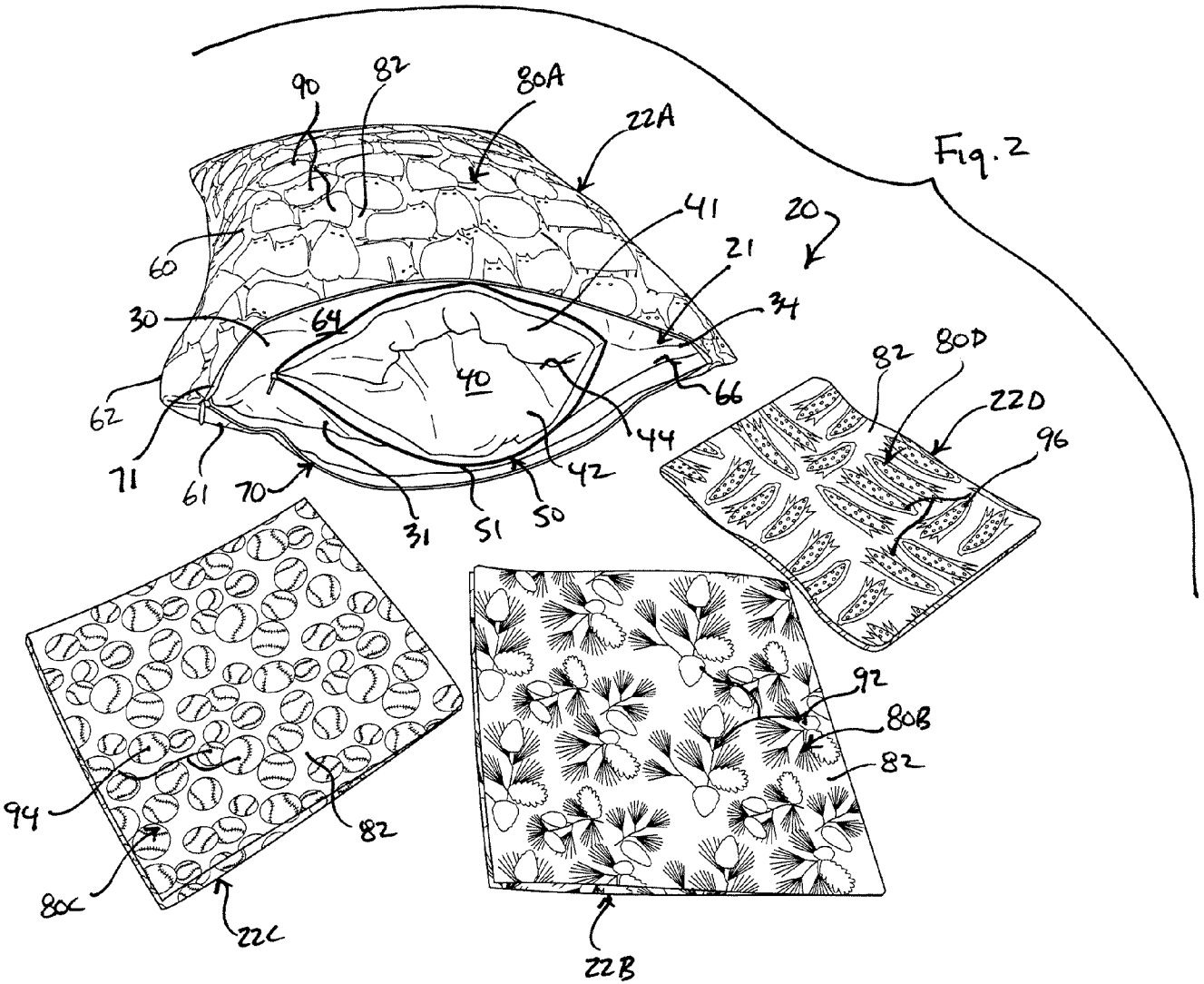
FIG. 2 is a perspective view corresponding to FIG. 1, illustrating a first one of the pillowcases drawn over the pillow, and a remaining plurality of the pillowcases positioned next to the pillow, the first one of the pillowcases includes a pillowcase inlet to an interior of the first one of the pillowcases, a pillowcase inlet closure, and the pillowcase inlet is in an open position corresponding to an opening position of pillowcase inlet closure.
Figure 3:
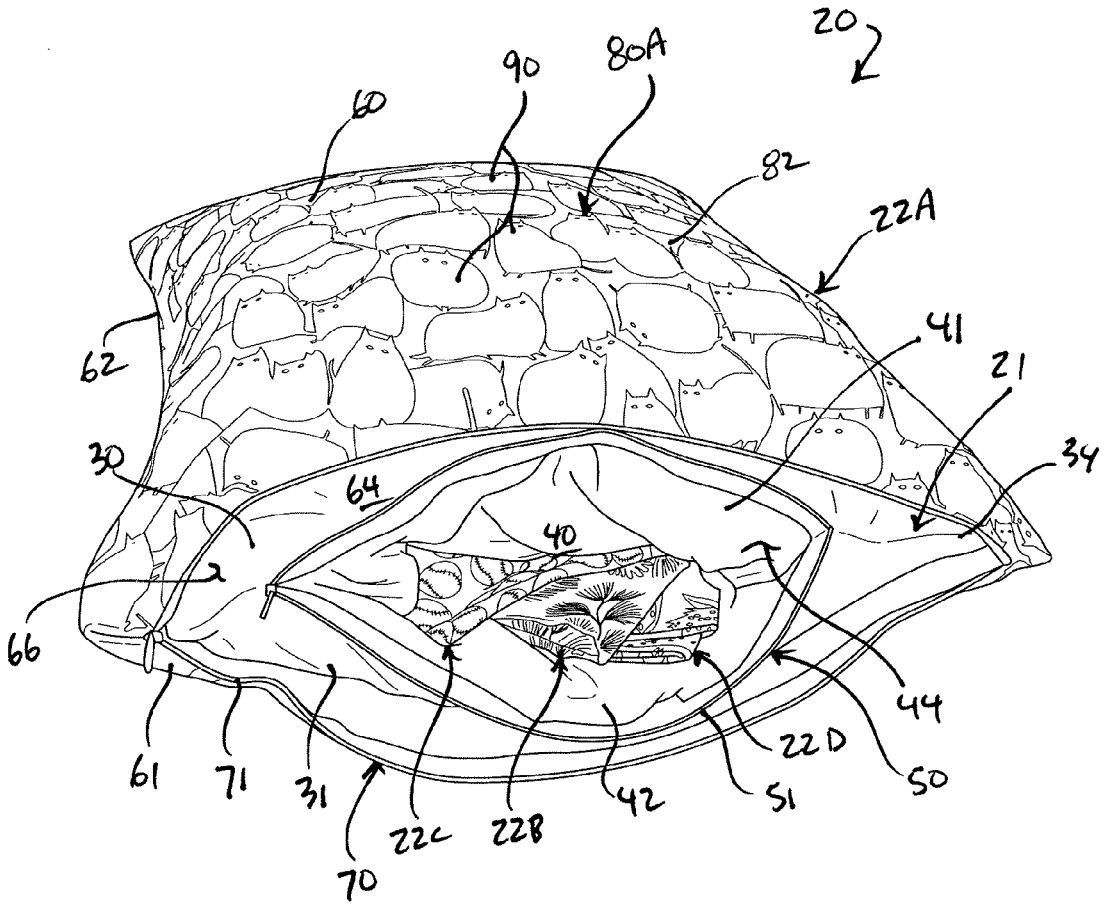
FIG. 3 is a perspective view corresponding to FIG. 2 illustrating the remaining plurality of the pillowcases positioned within the pocket of the pillow.
Figure 4:
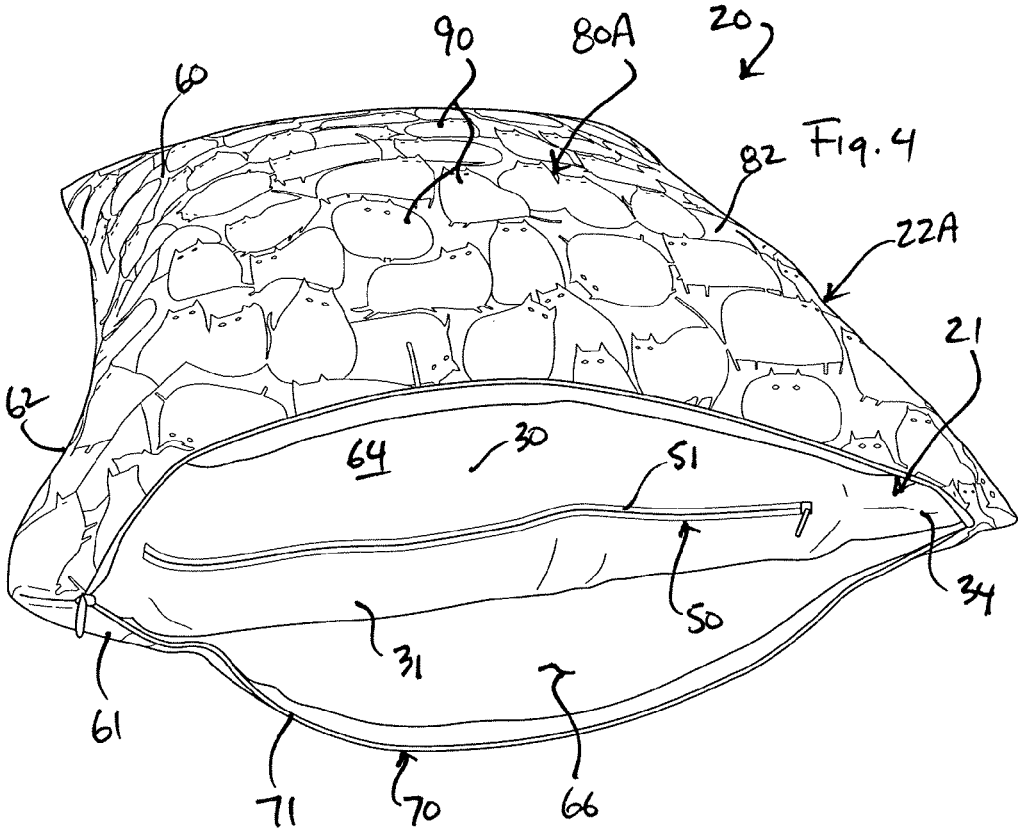
FIG. 4 is a perspective view corresponding to FIG. 3, wherein the pocket inlet is in a closed position corresponding to a closing position of the pocket inlet closure for enclosing the remaining plurality of the pillowcases in the pocket.

Each one of pillowcases 22 is a decorative pillowcase. More specifically, each one of pillowcases 22 is a removable cover for pillow 21 and has a decorative theme, wherein the term "theme" is given its customary meaning of a unifying or dominant motif. The decorative themes of the pillowcases 22 are different from one another, according to the principle of the invention. Referring to FIGS. 2, 3, and 4, pillowcase 22A is formed from a pair of pillowcase panels, including first pillowcase panel 60 and second pillowcase panel 61. First and second pillowcase panels 60 and 61 are made of cotton, polyester, a cotton/polyester blend, silk, or other selected textile material or combination of selected textile materials commonly used for pillowcases. First and second pillowcase panels 60 and 61 are square in shape in this example so as to correspond in shape to the generally square shape of pillow 21 as determined by the shape of top and bottom panels 30 and 31 of pillow 21, and can be made in other selected shapes as desired, such as rectangular, round, oval, etc., so as to correspond to the selected shape of pillow 21.

First and second pillowcase panels 60 and 61 are joined along three sides at their periphery to define peripheral edge 62 around pillowcase 22A so as to form the inside closed portion of pillowcase 22A, namely, interior 64 of pillowcase 22A that extends into pillowcase 22A. First pillowcase panel 60 and second pillowcase panel 61 define and enclose interior 64 and are joined customarily with stitching, adhesive, or the like, that join first and second pillowcase panels 60 and 61 fixedly together. The fourth side of first pillowcase panel 60 and the fourth side of second pillowcase panel 61 form a pillowcase inlet 66 to interior 64 at peripheral edge 62. Interior 64 is accessible through pillowcase inlet 66. Interior 64 is sufficiently sized to accept pillow 21 inserted therein through pillowcase inlet 66, and pillow 21 can be withdrawn from interior 64 through pillowcase inlet 66.

Pillowcase 22A further includes a pillowcase inlet closure 70. Pillowcase inlet 66 is open to enable access therethrough to interior 64 when pillowcase inlet closure 70 is in an open or opening position in FIGS. 2-4. Pillowcase inlet 66 is closed to disable access therethrough to interior 64 when pillowcase inlet closure 70 is in a closed position in FIG. 5. Pillowcase inlet closure 70 is formed along peripheral edge 62 at pillowcase inlet 66. Pillowcase inlet closure 70 is a slide fastener, specifically a zipper 71 in this illustrative embodiment, such as a metal, plastic, or composite zipper. Zipper 71, a conventional closure, consist of the customary toothed tracks or spiral metal or plastic coils, each bordering one of two edges of peripheral edge 62 at pillowcase inlet 66 to be joined, and a sliding piece that interlocks them in the closing position of the zipper 71 closing pillowcase inlet 66 when the sliding piece is pulled in one direction and that separates them in the opening position of the zipper 71 opening pillowcase inlet 66 when the sliding piece is pulled in the opposite direction. Various snap, button, hook-and-loop, or other like or similar fastener can be used for pillowcase inlet closure 70 in alternate embodiments.

In FIGS. 1-4, pillowcase 22A has theme 80. Theme 80, a decorative theme, is on outer surface 82 of first pillowcase panel 60 and second pillowcase panel 61. Theme 80 can be printed onto or otherwise applied to outer surface 82, or theme 80 can be woven or otherwise formed in the substance of first and second pillowcase panels 60 and 61 so as to be on or otherwise at outer surface 82 of pillowcase 22A.

Except for the different themes of pillowcases 22 discussed more fully below, pillowcases 22B, 22C, and 22D are identical to pillowcase 22A in every respect. Accordingly, the foregoing discussion of the structure of pillowcase 22A applies equally to pillowcase 22B, pillowcase 22C, and pillowcase 22D, and the same reference characters used to denote the structural components of pillowcase 22A are used for pillowcases 22B, 22C, and 22D, throughout the various figures where appropriate.

In FIG. 1, pillowcase 22A has theme 80A, pillowcase 22B has theme 80B, pillowcase 22C has theme 80C, and pillowcase 22D has theme 80D. Themes 80A, 80B, 80C, and 80D are different from one another, according to the invention. Themes 80A, 80B, 80C, and 89D also do not relate to one another or otherwise correspond to one another, in accordance with the invention. In this example, theme 80A of pillowcase 22A is a Halloween theme represented in this embodiment by a pattern 90 of cats, theme 80B of pillowcase 22B is a Christmas theme represented in this embodiment by a pattern 92 of pine branches and pine cones, theme 80C of pillowcase 22C is a sports theme represented in this embodiment by a pattern 94 of baseballs, and theme 80D of pillowcase 22D is a Thanksgiving theme represented in this embodiment by a pattern 90 of corn on the cob. Pattern 90 is chosen to represent the theme of Halloween in pillowcase 22A, pattern 92 is chosen to represent the theme of Christmas in pillowcase 22B, pattern 94 is chosen to represent the theme of sports in pillowcase 22C, and pattern 96 is chosen to represent the theme of Thanksgiving in pillowcase 22D. Pattern 90 can be a pattern of spiders, a pattern of pumpkins, or the like to represent the theme of Halloween. Pattern 92 can be a pattern of Christmas ornaments, Christmas presents, Christmas stockings, or the like to represent the theme of Christmas. Pattern 94 can be a pattern of footballs, a pattern of basketballs, or the like to represent the theme of sports. Pattern 96 can be a pattern of pilgrims, a pattern of turkeys, or the like to represent the theme of Thanksgiving. Themes 80A, 80B, 80C, and 80D are clearly different from one another. Themes 80A, 80B, 80C, and 80D also do not relate to one another or correspond to one another, in that theme 80A of Halloween does not relate or correspond to Christmas, sports, or Thanksgiving, theme 80B of Christmas does not relate or correspond to Halloween, sports, or Thanksgiving, theme 80C of sports does not relate or correspond to Halloween, Christmas, or Thanksgiving, and theme 80D of Thanksgiving does not relate or correspond to Halloween, Christmas, or sports.

Each of pillowcases 22A-22D is a removable cover for pillow 21, being adapted for being slipped over and from pillow 21, and has theme 80, and the themes 80A-80D of pillowcases 22A-22D are different from one another. This enables a user to selectively draw the respective pillowcases 22 over pillow 21 to decorate pillow 21 with the selected theme, and to selectively store the remaining plurality of pillowcases 22 in pocket 40 for later use.

In FIG. 1 pillowcases 22 are positioned adjacent to pillow 21 and pocket inlet 44 is in an open position when pocket inlet closure 50 in its opening position as shown. In this orientation of decorative pillow system 20, a selected one of pillowcases 22 may be drawn over pillow 21 for decorating pillow with the theme of the selected one of pillowcases 22, and the remaining pillowcases 22 can be selectively stored in pocket 40 of pillow 21. Pocket inlet 44 can be closed by placing pocket inlet closure 50 in its closing position for enclosing the pillowcases 22 placed therein, and pillowcase inlet 66 can be closed by placing pillowcase inlet closure 70 in its closing position enclosing pillow 21 in the selected one of the pillowcases 22. Storing and enclosing the unused pillowcases 22 in pocket 21 and enclosing pillow 21 in the remaining one of the pillowcases 22 disables the unused pillowcases from becoming lost or misplaced, and enables a user to open pillowcase inlet 66 by adjusting the pillowcase inlet closure 70 from its closing position to its opening position, withdraw pillow 21 from the interior of the selected one of the pillowcases 22 through open pillowcase inlet 66 thereof, open pocket inlet 44 by adjusting pocket inlet closure 50 from its closing position to its opening position, withdraw another selected one of pillowcases 22 from pocket 40 through open pocket inlet 44, apply the previously selected one of the pillowcases 22 into pocket 40 through open pocket inlet 44, close pocket inlet 44 by adjusting pocket inlet closure 50 from its open position to its closed position for enclosing the pillowcase 22 stored therein, open pillowcase inlet 66 of the other selected one of pillowcases 22 by adjusting the pillowcase inlet closure 70 thereof from its closing position to its opening position, if not already open, insert pillow 21 into interior 64 of the other selected one of pillowcases 22 through open pillowcase inlet 66 thereof, and the close pillowcase inlet 66 of the other selected one of pillowcases 22 by adjusting the pillowcase inlet closure 70 thereof from its opening position to its closing position for enclosing pillow 21 in interior 64 of the other selected one of pillowcases 22. This process may be repeated as desired for selectively decorating pillow 21 with the chosen theme 80 of the chosen pillowcase 22, and storing the remaining pillowcases 22 in pocket 40 of pillow 21 for later use.

Pillowcase 22A having theme 80A of Halloween can be chosen to be drawn/slipped over pillow 21 during Halloween, pillowcase 22B having theme 80B of Christmas can be chosen to be drawn/slipped over pillow 21 during Christmas, pillowcase 22C having theme 80C of sports can be chosen to be drawn/slipped over pillow 21 during a baseball game or during baseball season, and pillowcase 22D having theme 80D of Thanksgiving can be chosen to be drawn/slipped over pillow 21 during Thanksgiving. Any selected themes 80 can be chosen for pillowcases 22. Decorative pillow system 20 incorporates four pillowcases 22 each having a unique theme 80. Less than four pillowcases 22, such as three pillowcases 22 or at least two pillowcases 22, can be used in decorative pillow system 20 in alternate embodiments. In this respect, in a particular embodiment one or more of the pillowcases 22, the one or more unused pillowcases 22, can be stored in pocket 40, and a remaining one of pillowcases 22 can be drawn over pillow for decorating pillow 21 with the theme 80 thereof. More than four pillowcases 22, such as five, six, seven, or more pillowcases, can be used in decorative pillow system 20 in alternate embodiments. Pocket 40 is selectively sized to accommodate all of pillowcases 22 of decorative pillow system 20, which enables all of pillowcases 22 to be stored and enclosed in pocket 40 when desired.

Figure 5:
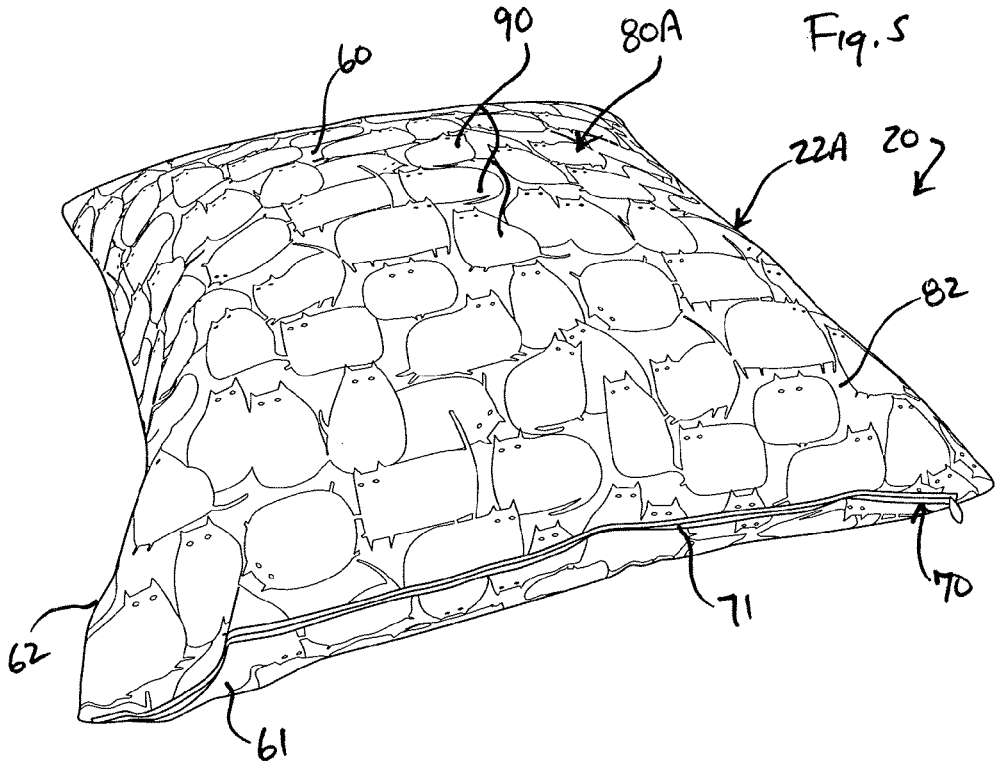
FIG. 5 is a perspective view corresponding to FIG. 4, wherein the pillowcase inlet of the first one of the pillowcases is in a closed position corresponding to a closing position of the pillowcase inlet closure for enclosing the pillow within the first one of the pillowcases.

In FIG. 2, as a matter of example, pillowcase 22A is drawn over pillow 21, and a remaining plurality of the pillowcases, namely, pillowcases 22B, 22C, and 22D are folded and are positioned next to pillow 21, and pillowcase inlet 66 is in its open position corresponding to the opening position of pillowcase inlet closure 70. Pillowcase 22A is drawn over pillow 21 by hand, whereby the end of pillow 21 opposite to pocket inlet 44 is initially inserted into interior 64 of pillowcase 22A through open pillowcase inlet 66 and the remainder of pillow 21 is then stuffed into interior 64 through open pillowcase inlet 66 until pillow 21 is fully received in interior 64, open pocket inlet 44 is juxtaposed relative to open pillowcase inlet 66 as shown in FIG. 2, and outer surface 82 faces outwardly presenting pattern 90 for viewing thereby decorating pillow 21 with pattern 90. To complete configuring pillow 21 with pillowcase 22A for decorating pillow 21 with the Halloween theme represented by pattern 90, the remaining pillowcases 22B, 22C, and 22D are folded and inserted into pocket 40 through open pocket inlet 44 in FIG. 3 when pocket inlet closure 50 is in its opening position, and pocket inlet 44 is closed with pocket inlet closure 50 in FIG. 4 enclosing pillowcases 22B, 22C, and 22D in pocket 40. In FIG. 4, pocket inlet 44 is in its closed position corresponding to the closing position of pocket inlet closure 50 enclosing pillowcases 22B, 22C, and 22D in pocket 40. Pillowcase inlet 66 is then closed with pillowcase inlet closure 70 in FIG. 5 enclosing pillow 21 in interior 64 of pillowcase 22A. In FIG. 5, pillowcase inlet 66 of pillowcase 22A is in its closed position corresponding to the closing position of pillowcase inlet closure 70 enclosing pillow 21 within interior 64 of pillowcase 22A. In the configuration of decorative pillow system 20 in FIG. 5, pillowcase 22A decorates pillow 21 with the Halloween theme represented by theme 80A on outer surface 82 of pillowcase 22A, and the remaining pillowcases 22B, 22C, and 22D, are safely and securely enclosed and stored in pocket 40 of pillow 21. This process can be repeated for each of pillowcases 22B, 22C, and 22D. The pillowcases stored in pocket 40 are folded for enabling compact storage thereof in pocket 40, and the pillowcase slipped over pillow 21 is unfolded, if necessary, and then slipped over pillow 21 as discussed above.

Figure 6:
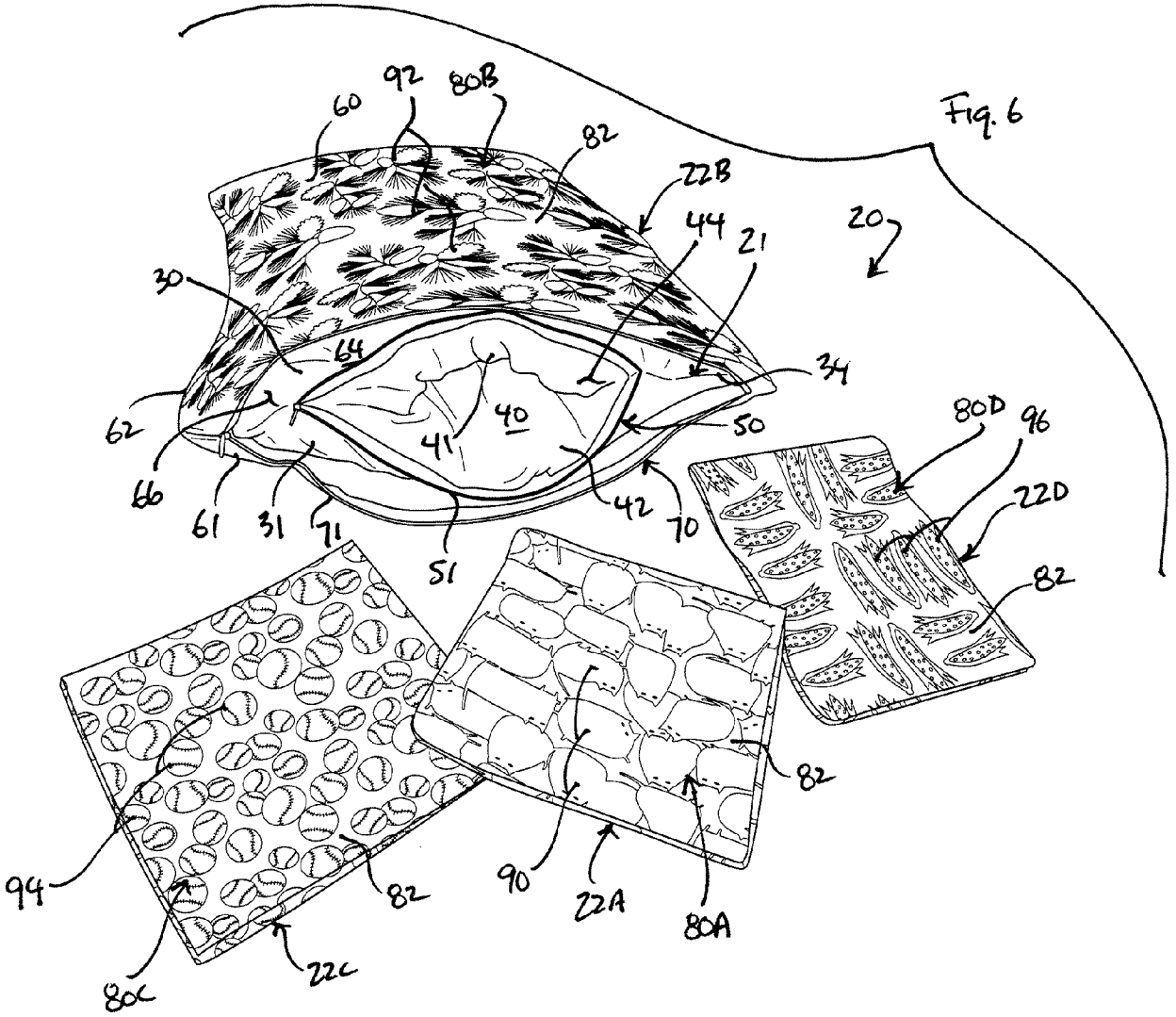
FIG. 6 is a perspective view corresponding to FIG. 1, illustrating a second one of the pillowcases drawn over the pillow, and a remaining plurality of the pillowcases positioned next to the pillow, the second one of the pillowcases includes a pillowcase inlet to an interior of the second one of the pillowcases, a pillowcase inlet closure, and the pillowcase inlet is in an open position corresponding to an opening position of pillowcase inlet closure.
Figure 7:
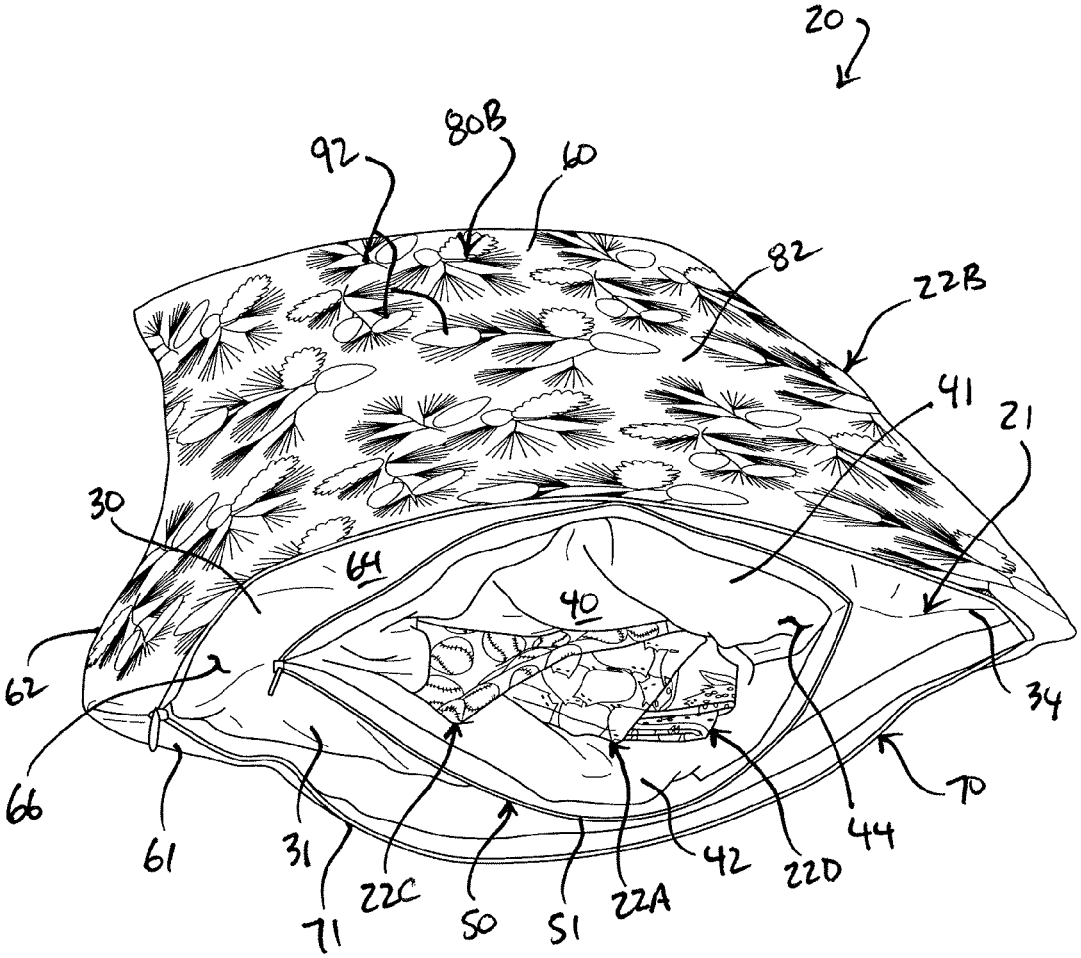
FIG. 7 is a perspective view corresponding to FIG. 6 illustrating the remaining plurality of the pillowcases positioned within the pocket of the pillow.
Figure 8:
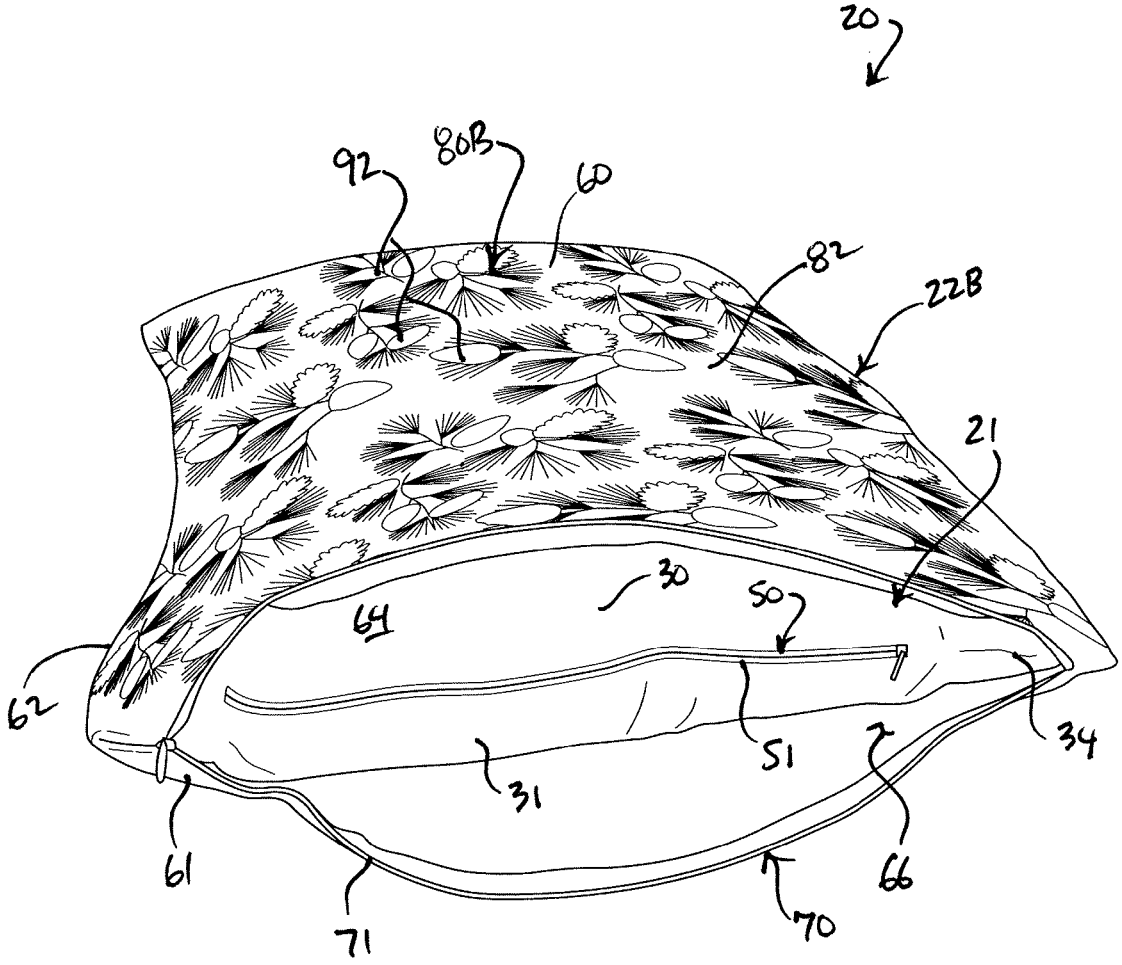
FIG. 8 is a perspective view corresponding to FIG. 7, wherein the pocket inlet is in a closed position corresponding to a closing position of the pocket inlet closure for enclosing the remaining plurality of the pillowcases in the pocket.
Figure 9:
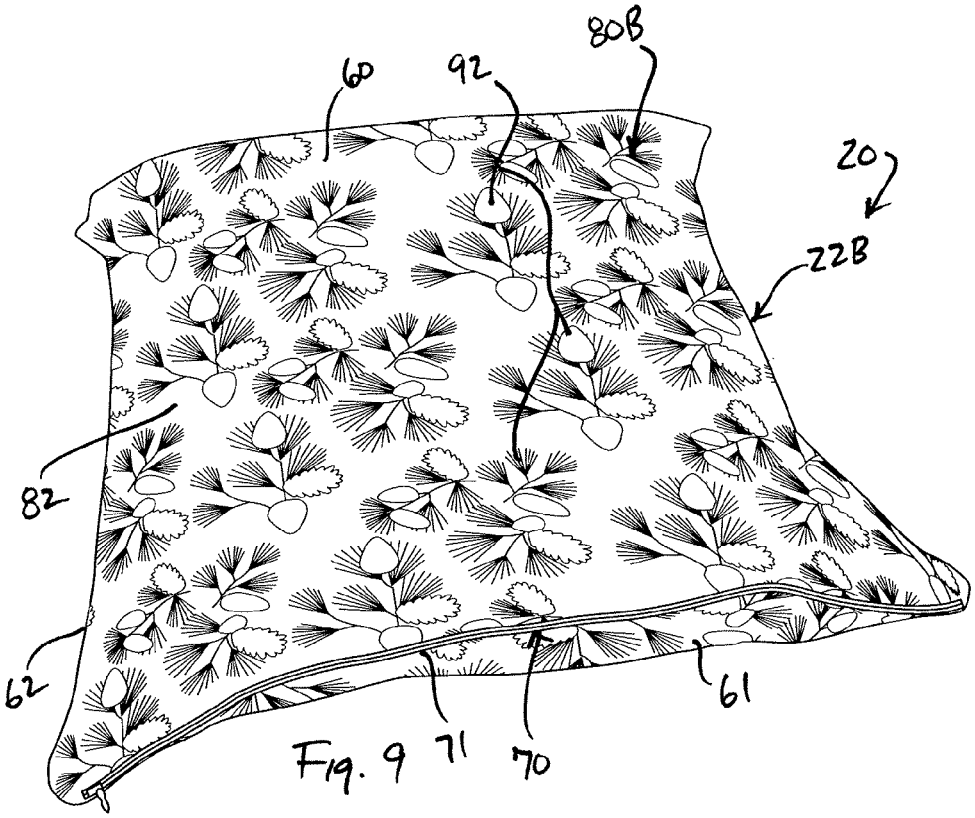
FIG. 9 is a perspective view corresponding to FIG. 8, wherein the pillowcase inlet of the second one of the pillowcases is in a closed position corresponding to a closing position of the pillowcase inlet closure for enclosing the pillow within the second one of the pillowcases.
Figure 10:
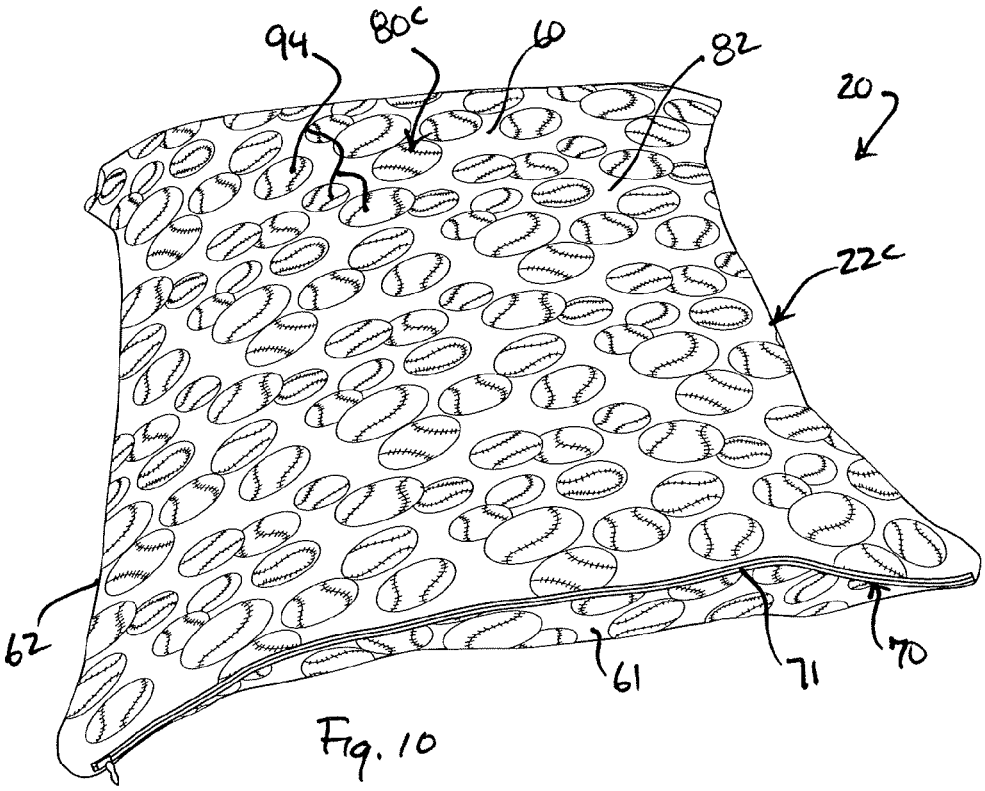
FIG. 10 is a view similar to that of FIGS. 5 and 9 illustrating a third one of the pillowcases first illustrated in FIG. 1 drawn over and enclosing the pillow.
Figure 11:
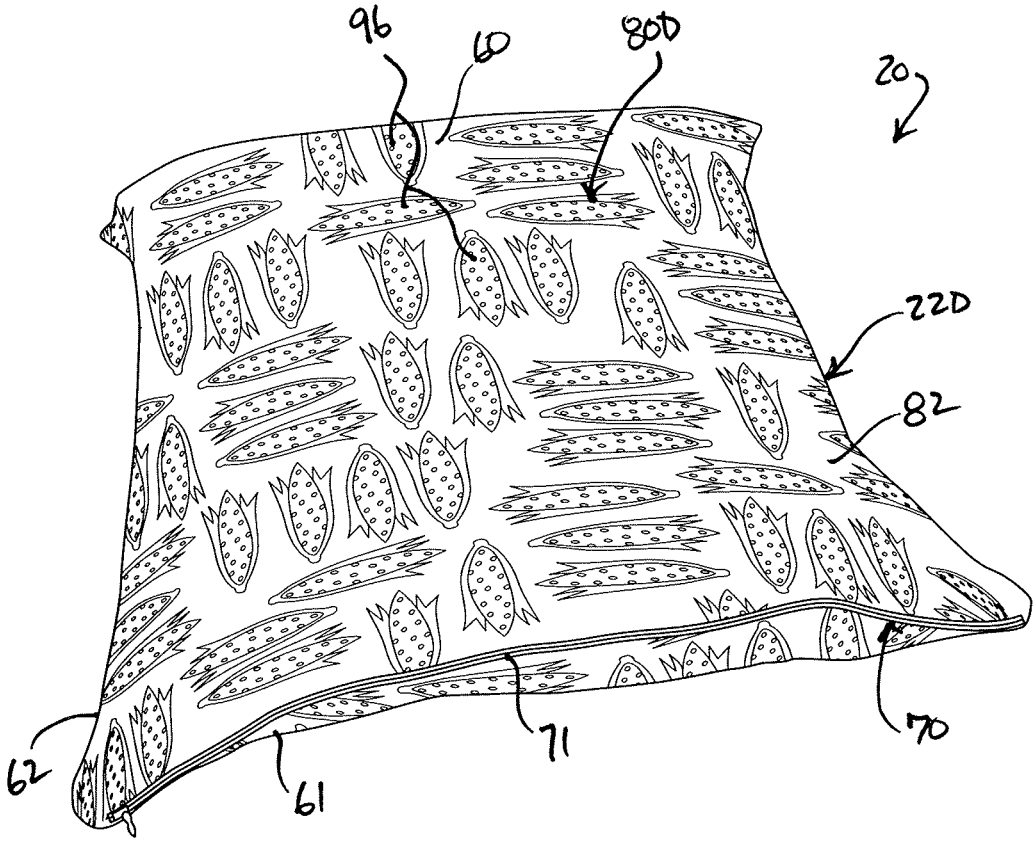
FIG. 11 is a view similar to that of FIGS. 5, 9, and 10 illustrating a fourth one of the pillowcases first illustrated in FIG. 1 drawn over and enclosing the pillow.

In another example, from the orientation of decorative pillow system 20 in FIG. 1, in FIG. 6 pillowcase 22B is drawn over pillow 21 and a remaining plurality of the pillowcases, namely, pillowcases 22A, 22C, and 22D, are folded and are positioned next to pillow 21, and pillowcase inlet 66 is in its open position corresponding to the opening position of pillowcase inlet closure 70. Again, pillowcase 22B is drawn over pillow 21 by hand, whereby the end of pillow 21 opposite to pocket inlet 44 is initially inserted into interior 64 of pillowcase 22B through open pillowcase inlet 66 and the remainder of pillow 21 is then stuffed into interior 64 through open pillowcase inlet 66 until pillow 21 is fully received in interior 64, open pocket inlet 44 is juxtaposed relative to open pillowcase inlet 66 as shown in FIG. 6, and outer surface 82 faces outwardly presenting pattern 92 for viewing thereby decorating pillow 21 with pattern 92. To complete configuring pillow 21 with pillowcase 22B for decorating pillow 21 with the Christmas theme represented by pattern 92, the remaining pillowcases 22A, 22C, and 22D are folded and inserted into pocket 40 through open pocket inlet 44 in FIG. 7 when pocket inlet closure 50 is in its opening position, and pocket inlet 44 is closed with pocket inlet closure 50 in FIG. 8 enclosing pillowcases 22A, 22C, and 22D in pocket 40. In FIG. 8, pocket inlet 44 is in its closed position corresponding to the closing position of pocket inlet closure 50 enclosing pillowcases 22A, 22C, and 22D in pocket 40. Pillowcase inlet 66 is then closed with pillowcase inlet closure 70 in FIG. 9 enclosing pillow 21 in interior 64 of pillowcase 22B. In FIG. 9, pillowcase inlet 66 of pillowcase 22B is in its closed position corresponding to the closing position of pillowcase inlet closure 70 enclosing pillow 21 within interior 64 of pillowcase 22B. In the configuration of decorative pillow system 20 in FIG. 9, pillowcase 22B decorates pillow 21 with the Christmas theme represented by theme 80B on outer surface 82 of pillowcase 22B, and the remaining pillowcases 22A, 22C, and 22D, are safely and securely enclosed and stored in pocket 40 of pillow 21. Again, this process can be repeated for each of pillowcases 22A, 22C, and 22D. As a matter of illustration and reference, in FIG. 10 decorative pillow system 10 is shown with pillowcase 22C drawn over and enclosing pillow 21 decorating pillow 21 with the sports theme represented by theme 80C on outer surface 82 of pillowcase 22C with the remaining pillowcases 22A, 22B, and 22D, safely and securely enclosed and stored in pocket 40 of pillow 21, and FIG. 11 decorative pillow system 10 is shown with pillowcase 22D drawn over and enclosing pillow 21 decorating pillow 21 with the Thanksgiving theme represented by theme 80D on outer surface 82 of pillowcase 22D with the remaining pillowcases 22A, 22B, and 22C, safely and securely enclosed and stored in pocket 40 of pillow 21.

Those having regard for the art will readily appreciate that an exemplary decorative pillow system 20 is disclosed, which enables a user to selectively draw a chosen pillowcase 22 over pillow 21 to decorate pillow with the theme 80 of the chosen pillowcase 22, and to safely store the one or more unused pillowcases 22 in pocket 40. The different themes 80 of pillowcases 22 enables a user to decorate pillow 21 selectively with different themes as desired without having to purchase numerous, differently-themed pillows, according to the invention. Furthermore, a decorative pillow system 20 constructed and arranged in accordance with the principle of the invention can incorporate any selected number of pillowcases, and in any event no less than two pillowcases, depending on the number of themes the user desires to have at his or her disposal for decorating pillow 21 according to this disclosure.

The present invention is described above with reference to illustrative embodiments. However, those skilled in the art will recognize that changes and modifications may be made in the described embodiments without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A decorative pillow system, comprising:

a pillow, the pillow includes a pocket formed internally therein, and a pocket inlet to the pocket;

pillowcases, each of the pillowcases is a removable cover for the pillow and has a decorative theme, and the decorative themes of the pillowcases are different from one another;

each one of the pillowcases when drawn over the pillow decorates the pillow with the decorative theme thereof forming a decorative pillow item useful for decorating, wherein the decorative themes define different decorations for the pillow;

the pillowcases comprise at least a first pillowcase and a second pillow case;

the pillow, the first pillowcase, and the second pillowcase are adjustable between a first decorative condition defining a first decorative pillow item, and a second decorative condition defining a second decorative pillow item;

the first decorative condition comprising:

the first pillowcase is stored in the pocket of the pillow;

the second pillowcase is drawn over the pillow decorating the pillow with the decorative theme thereof forming the first decorative pillow item useful for decorating;

the first and second pillowcases being kept together with the pillow; and the first pillowcase stored in the pocket of the pillow disables the first pillowcase from being lost or misplaced relative to the pillow, and enables a) the first pillowcase to be located in the pocket without having to search elsewhere for the first pillowcase and removed from in the pocket, b) the second pillowcase to be removed from the pillow and replaced with the first pillowcase for changing the decoration of the pillow from the decorative theme of the second pillowcase to the decorative theme of the first pillowcase for forming the second decorative pillow item useful for decorating, and c) the second pillowcase to be stored in the pocket of the pillow for disabling the second pillowcase from being lost or misplaced relative to the pillow and for enabling the second pillowcase to be located in the pocket without having to search elsewhere for the second pillowcase when the second pillowcase is stored in the pocket;

the second decorative condition comprising:

the second pillowcase is stored in the pocket of the pillow;

the first pillowcase is drawn over the pillow decorating the pillow with the decorative theme thereof forming the second decorative pillow item useful for decorating;

the first and second pillowcases being kept together with the pillow; and the second pillowcase stored in the pocket of the pillow disables the second pillowcase from being lost or misplaced relative to the pillow, and enables a) the second pillowcase to be located in the pocket without having to search elsewhere for the second pillowcase and removed from in the pocket, b) the first pillowcase to be removed from the pillow and replaced with the second pillowcase for changing the decoration of the pillow from the decorative theme of the first pillowcase to the decorative theme of the second pillowcase for forming the first decorative pillow item useful for decorating, and c) the first pillowcase to be stored in the pocket of the pillow for disabling the first pillowcase from being lost or misplaced relative to the pillow and for enabling the first pillowcase to be located in the pocket without having to search elsewhere for the first pillowcase when the first pillowcase is stored in the pocket.

2. The decorative pillow system according to claim 1, wherein the first pillowcase and the second pillowcase each includes a closure, each of the first pillowcase and the second pillowcase is in an open position, when the closure thereof is in an opening position, and is in a closed position, when the closure thereof is in a closing position.

3. The decorative pillow system according to claim 2, wherein the closure of the second pillowcase is in the closing position enclosing the pillow therein, when the second pillowcase is drawn over the pillow, and the closure of the first pillowcase is in the closing position enclosing the pillow therein, when the first pillowcase is drawn over the pillow.

4. The decorative pillow system according to claim 2, wherein each of the closures is a zipper.

5. A decorative pillow system, comprising:

a pillow, the pillow includes a pocket formed internally therein, a pocket inlet to the pocket, and a pocket inlet closure, the pocket inlet is in an open position, when the pocket inlet closure is in an opening position, and the pocket inlet is in a closed position, when the pocket inlet closure is in a closing position;

pillowcases, each of the pillowcases is a removable cover for the pillow and has a decorative theme, and the decorative themes of the pillowcases are different from one another;

each one of the pillowcases when drawn over the pillow decorates the pillow with the decorative theme thereof forming a decorative item useful for decorating, wherein the decorative themes define different decorations for the pillow;

the pillowcases comprise at least a first pillowcase and a second pillow case;

the pillow, the first pillowcase, and the second pillowcase are adjustable between a first decorative condition defining a first decorative pillow item, and a second decorative condition defining a second decorative pillow item;

the first decorative condition comprising:

the first pillowcase is stored in the pocket of the pillow and is enclosed by the pocket inlet closure;

the second pillowcase is drawn over the pillow decorating the pillow with the decorative theme thereof forming the first decorative pillow item useful for decorating;

the first and second pillowcases being kept together with the pillow; and the first pillowcase stored in the pocket of the pillow disables the first pillowcase from being lost or misplaced relative to the pillow, and enables a) the first pillowcase to be located in the pocket without having to search elsewhere for the first pillowcase and removed from in the pocket via the pocket inlet closure, b) the second pillowcase to be removed from the pillow and replaced with the first pillowcase for changing the decoration of the pillow from the decorative theme of the second pillowcase to the decorative theme of the first pillowcase for forming the second decorative pillow item useful for decorating, and c) the second pillowcase to be stored in the pocket of the pillow for disabling the second pillowcase from being lost or misplaced relative to the pillow and for enabling the second pillowcase to be located in the pocket without having to search elsewhere for the second pillowcase when the second pillowcase is stored in the pocket;

the second decorative condition comprising:

the second pillowcase is stored in the pocket of the pillow;

the first pillowcase is drawn over the pillow decorating the pillow with the decorative theme thereof forming the second decorative pillow item useful for decorating;

the first and second pillowcases being kept together with the pillow; and the second pillowcase stored in the pocket of the pillow disables the second pillowcase from being lost or misplaced relative to the pillow, and enables a) the second pillowcase to be located in the pocket without having to search elsewhere for the second pillowcase and removed from in the pocket via the pocket inlet closure, b) the first pillowcase to be removed from the pillow and replaced with the second pillowcase for changing the decoration of the pillow from the decorative theme of the first pillowcase to the decorative theme of the second pillowcase for forming the first decorative pillow item useful for decorating, and c) the first pillowcase to be stored in the pocket of the pillow for disabling the first pillowcase from being lost or misplaced relative to the pillow and for enabling the first pillowcase to be located in the pocket without having to search elsewhere for the first pillowcase when the first pillowcase is stored in the pocket.

6. The decorative pillow system according to claim 5, wherein the pocket inlet closure is a zipper.

7. The decorative pillow system according to claim 5, wherein the first pillowcase and the second pillowcase each includes a pillowcase closure, each of the first pillowcase and the second pillowcase is in an open position, when the pillowcase closure thereof is in an opening position, and is in a closed position, when the pillowcase closure thereof is in a closing position.

8. The decorative pillow system according to claim 7, wherein the pillowcase closure of the second pillowcase is in the closing position enclosing the pillow therein, when the second pillowcase is drawn over the pillow, and the closure of the first pillowcase is in the closing position enclosing the pillow therein, when the first pillowcase is drawn over the pillow.

9. The decorative pillow system according to claim 7, wherein each of the pillowcase closures is a zipper.

* * * * *